US005681243A

United States Patent [19]

Criss

[11] Patent Number: 5,681,243

[45] Date of Patent: Oct. 28, 1997

[54] HAND AND FOREARM EXERCISE DEVICE

[76] Inventor: David L. Criss, 4590 Briarwood Dr., Stevensville, Mich. 49127

[21] Appl. No.: 440,041

[22] Filed: May 12, 1995

[51] Int. Cl.[6] ..... A63B 23/16

[52] U.S. Cl. ..... 482/49

[58] Field of Search ..... 482/49, 121, 148, 482/45, 44

[56] References Cited

U.S. PATENT DOCUMENTS

| | | | |
|---|---|---|---|
| 1,190,781 | 7/1916 | Maher . | |
| 2,197,409 | 4/1940 | Jackson . | |
| 3,129,939 | 4/1964 | Stock . | |
| 4,251,071 | 2/1981 | Norton | 272/137 |
| 4,711,445 | 12/1987 | Whitehead | 482/49 |
| 4,798,377 | 1/1989 | White | 272/67 |
| 5,009,416 | 4/1991 | Caruthers | 272/143 |
| 5,076,569 | 12/1991 | Gootter | 482/49 |
| 5,217,029 | 6/1993 | Shields | 482/49 |
| 5,224,397 | 7/1993 | Yoo | 272/143 |
| 5,287,767 | 2/1994 | Engelstein | 74/558 |

OTHER PUBLICATIONS

Advertisement; Magalog Marketing Group, 1905 Swarthmore Ave., Lakewood, NJ 08701; undated.

*Primary Examiner*—Stephen R. Crow

*Attorney, Agent, or Firm*—Dunlap & Codding, P.C.

[57] ABSTRACT

An exercise device for exercising an individual's hand and forearm while grasping an object is provided. The exercise device includes a resilient body member dimensioned to be compressively gripped with the hand of the individual and having a bore extending through the resilient body member and a slit extending from the bore along the length of the bore such that the resilient body member is selectively movable between an open position and a closed position. The diameter of the bore is dimensioned such that the resilient body member frictionally engages the object when the object is positioned in the bore while permitting sliding movement of the resilient body member along the object when the resilient body member is in a noncompressed condition and such that the resilient body member frictionally engages the object and prevents slidingly movement of the resilient body member along the object when the object is positioned in the bore and the resilient body member is in a compressed condition.

15 Claims, 3 Drawing Sheets

HAND AND FOREARM EXERCISE DEVICE

BACKGROUND OF THE INVENTION

1. Field of the Invention.

The present invention is generally related to exercise devices, and more particularly, but not by way of limitation, to an improved device for exercising an individual's hands and forearms while grasping an object, such as a steering wheel.

2. Description of Related Art.

Many hand exercise devices have been developed which are used to increase the strength in the hand and forearm of an individual. Such devices include rubber balls, foam rubber pads, and handles interconnected with a coiled spring. While these devices have proven effective for stimulating and strengthening the muscles of the hand and forearm, these devices are designed to be independently gripped in the hand. That is, an individual cannot use these devices and simultaneously grasp and manipulate another object, such as a steering wheel, a lawn mower, or a garden tool.

During long periods of inactivity, such as encountered when driving long distances in a motor vehicle for example, it is often desirable to have the ability to exercise one's hands and forearms to increase strength and relieve stress and fatigue, while at the same time maintaining safe and total control over the vehicle.

Several prior art hand exercise devices have been proposed which are positionable on another object and allow an individual to exercise the hands while manipulating another object. One such device is disclosed in U.S. Pat. No. 4,798,377, issued to White. The White patent discloses a bicycle handle bar with a coil spring hand exerciser affixed thereto. Because the device is affixed to the handle bar grip, removal of the device is inconvenient in that the handle bar grip must also be removed, thereby significantly altering the gripping portions of the handle bar.

U.S. Pat. No. 4,251,071, issued to Norton, discloses a resilient hand grip having an axial bore and a slit running therethrough to permit the hand grip to be placed on an elastic cord which is in turn stretched by an individual while gripping the hand grip. The hand grip frictionally engages the cord only when the hand grip is compressed. Thus, this device would be unsuitable for use on a steering wheel or some other object where the position of an individual's hands must be altered periodically, such as when turning the steering wheel, because the hand grip would freely slip along the steering wheel when the hand grip is not compressed thereby annoying the driver and potentially interfering with the operation of the vehicle.

To this end, a need exists for a hand exercise device positionable on an object so as to permit an individual to manipulate the object and exercise simultaneously and which is easily placed on and removed from the object while being frictionally engagable with the object in both a compressed and noncompressed condition and easily positioned along the object in the noncompressed condition. It is to such a device that the present invention is directed.

BRIEF DESCRIPTION OF THE DRAWINGS

FIG. 6 is a perspective view of a steering wheel having a pair of exercise devices constructed in accordance with the present invention disposed thereon and gripped by an individual.

DETAILED DESCRIPTION

Figure 1:
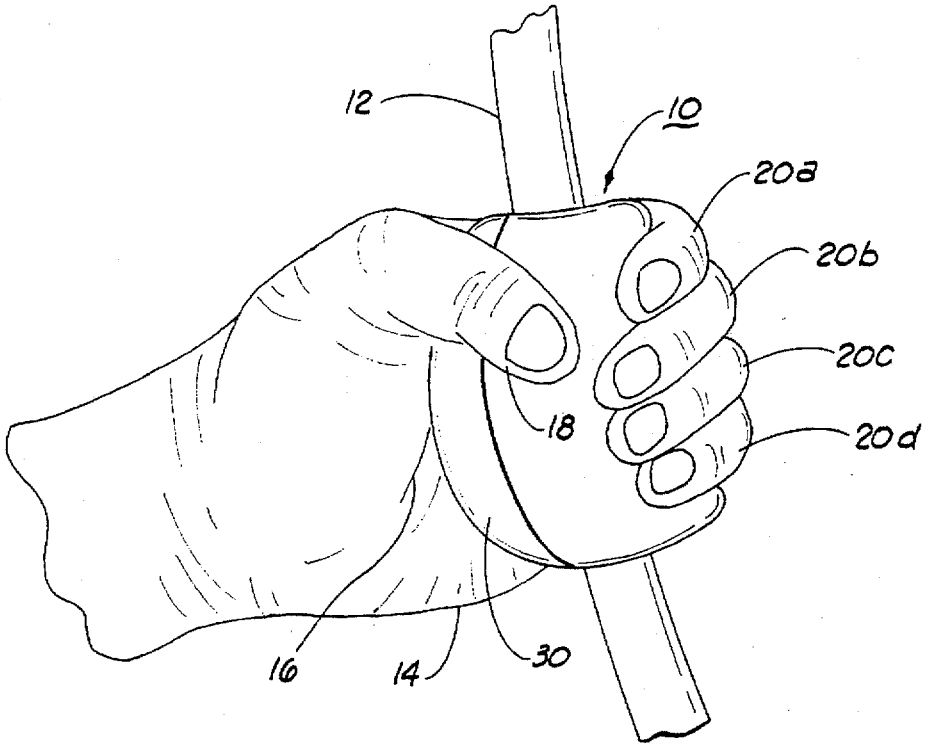
FIG. 1 is a perspective view of a exercise device constructed in accordance with the present invention shown positioned on a steering wheel and compressively gripped in an individual's hand.
Figure 2:
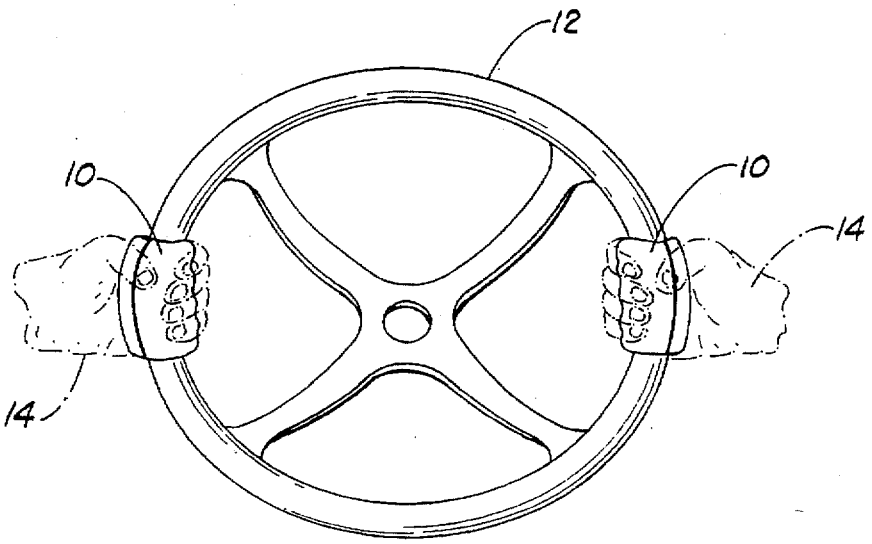
FIG. 2 is a perspective view of the exercise device of the present invention illustrating the device in an open position.
Figure 2:
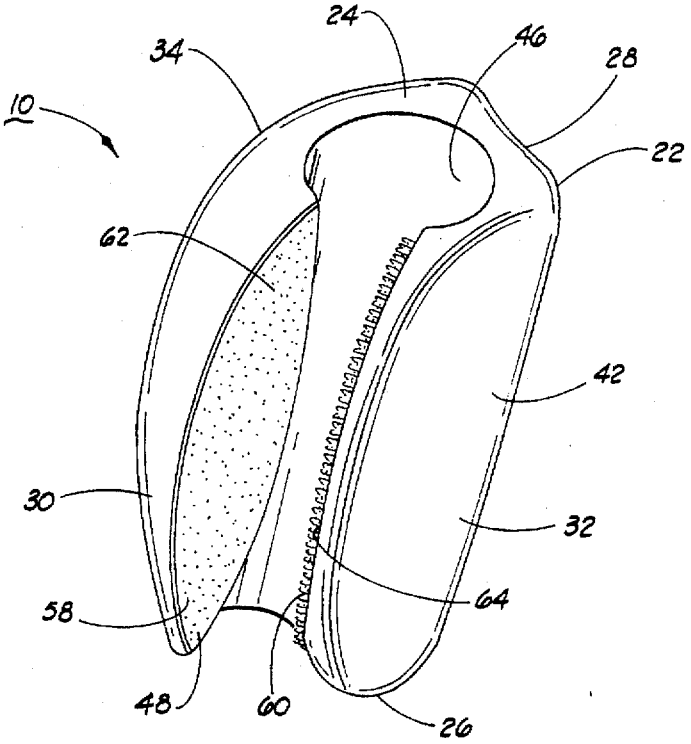

Referring now to the drawings, and more particularly to FIG. 1, an exercise device 10 for exercising an individual's hand and forearm, constructed in accordance with the present invention, is illustrated positioned about an object, such as a steering wheel 12, and compressively gripped by an individual's hand 14. The hand 14 is characterized has having a palm 16, a thumb 18, and a plurality of fingers 20*a*–20*d*.

Referring now to FIGS. 2–5, the exercise device 10 includes a resilient body member 22 dimensioned to be compressively gripped with the hand 14 of the individual. The resilient body member 22 is constructed of any suitable flexible, resiliently compressible material. However, to provide sufficient resistance when compressively gripping the exercise device 10 to exercise the individual's hand and forearm, the material should preferably have a compressibility such that the exercise device 10 has a compressibility which ranges from about 400 psi to about 750 psi when the exercise device 10 is positioned on the substantially noncompressible steering wheel 12. A suitable material is a flexible polyurethane known as RV-5021 (R)(T) and available from RENOSOL, Inc. of Ann Arbor, Mich. The resilient body member 22 can be formed by any suitable process, but is preferably formed using a conventional injection mold process which is well known to those of ordinary skill in the art.

Figure 3:
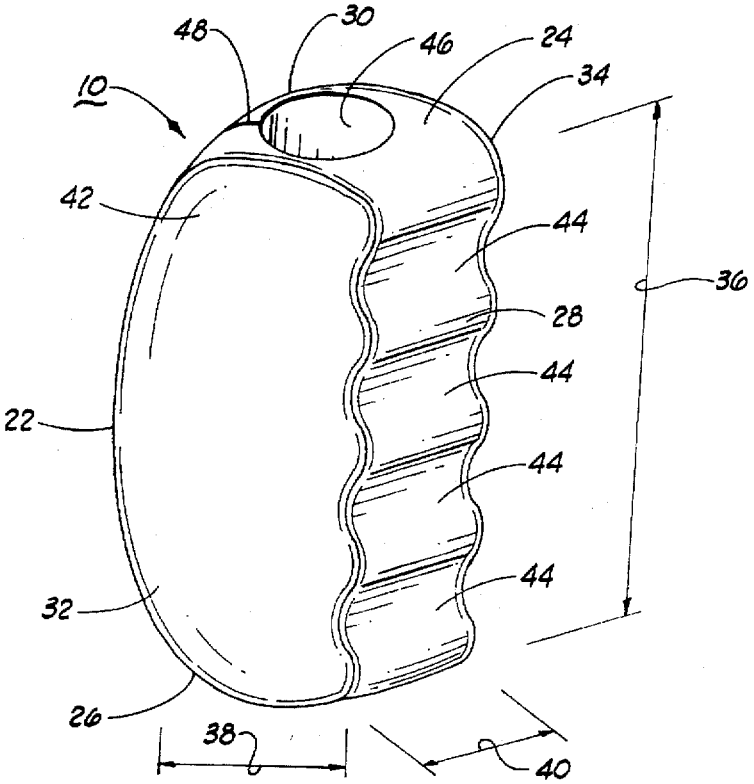
FIG. 3 is a perspective view of the exercise device of the present invention illustrating the device in a closed position and showing a plurality of finger depressions.

The resilient body member 22 is characterized as having a first end 24, a second end 26, a first side 28, a second side 30, a third side 32, and a fourth side 34. The distance between the first end 24 and the second end 26 defines a length 36 (FIG. 3); the distance between the first side 28 and the second side 30 defines a width 38 (FIG. 3); and the distance between the third side 32 and the fourth side 34 defines a thickness 40 (FIG. 3).

The resilient body member 22 is to be gripped in the hand 14 substantially as shown in FIG. 1. To this end, the length 36 is dimensioned to span the width of the hand 14, and the width 38 is dimensioned so that the resilient body member 22 fits in the hand 14 with the second side 30 positioned in the palm 16 and the fingers 20*a*–20*d* extending along a portion of the fourth side 34 around to the first side 28. The thickness 40 is dimensioned so that the ends of the fingers 20*a*–20*d* extend substantially across the first side 28 with the thumb 18 positioned on the third side 32 as shown in FIG. 1. It will be appreciated that the dimensions of the resilient body member 22 can be varied to accommodate different hand sizes.

The first end 24, the second end 26, the first side 28, the second side 30, the third side 32, and the fourth side 34 define an outer peripheral surface 42. The resilient body member 22 is provided with a plurality of depressions 44 formed on the outer peripheral surface 42 along the first side 28 of the resilient body member 22. Each of the depressions 44 is configured to receive one of the fingers 20*a*–20*d* thereby positioning the fingers 20*a*–20*d* on the first side 28 of the resilient body member 22 and enhancing the longitudinal grip of the fingers 20*a*–20*d* on the resilient body member 22 to allow the steering wheel 12 to be safely manipulated while compressively gripping the resilient body member 22.

As best shown in FIG. 1, the second side 30 of the resilient body member 22 is contoured to substantially conform to the curvature of the palm 16 when the hand 14 is gripped about the resilient body member 22.

To permit the resilient body member 22 to be positioned about an object, such as the steering wheel 12 (FIG. 1), the resilient body member 22 is formed with a bore 46 extending through the resilient body member 22 between the first end 24 and the second end 26 and a slit 48 extending from the outer peripheral surface 42 of the resilient body member 22 to the bore 46 along the length of the bore 46. The flexibility of the resilient body member 22 enables the resilient body member 22 to be selectively moved between an open position (FIG. 2) wherein the resilient body member 22 is separated along the slit 48 to provide access to the bore 46 so that the resilient body member 22 can be positioned about the steering wheel 12 with the steering wheel 12 disposed in the bore 46 and a closed position (FIG. 3) wherein the resilient body member 22 is adjoined along the slit 48 so as to maintain the resilient body member 22 positioned about the steering wheel 12.

Figure 4:
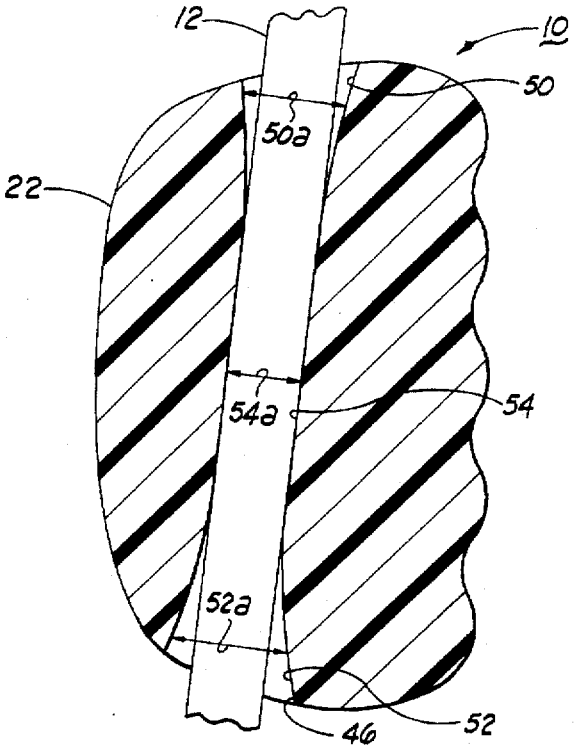
FIG. 4 is a cross-sectional view of the exercise device of the present invention illustrated in an noncompressed condition with a portion of a steering wheel disposed therethrough.

FIG. 4 shows a cross-section of the resilient body member 22 with the steering wheel 12 disposed through the bore 46 and the resilient body member 22 in a noncompressed condition. The bore 46 is dimensioned such that the resilient body member 22 frictionally engages the steering wheel 12 when the steering wheel 12 is positioned in the bore 46 while also permitting sliding movement of the resilient body member 22 along the steering wheel 12 when the resilient body member 22 is in the noncompressed condition. Thus, the exercise device 10 remains in a set position when disposed on the steering wheel 12 so that the exercise device 10 does not freely slide along the steering wheel 12 and thus interfere or annoy the vehicle operator. Furthermore, the exercise device 10 is selectively positionable along the steering wheel 12 by the application of force no greater than that exerted by the finger strength of the ordinary operator.

The resilient body member 22 frictionally engages the steering wheel 12 so as to prevent sliding movement of the resilient body member 22 along the steering wheel 12 when the steering wheel 12 is positioned in the bore 46 and the resilient body member 22 is in a compressed condition. This ensures that the exercise device 10 will not slip along the steering wheel 12 while the individual is using the exercise device 10 to permit the steering wheel 12 to be effectively manipulated while compressively gripping the exercise device 10, if desired.

As shown in FIG. 4, the bore 46 has a first end portion 50, a second end portion 52 and an intermediate portion 54; each portion having a diameter 50*a*, 52*a*, and 54*a*, respectively. To facilitate slidingly positioning the resilient body member 22 along the steering wheel 12 when the resilient body member 22 is in the noncompressed condition, the first end portion 50 and the second end portion 52 are each tapered relative to the intermediate portion 54 such that the diameter 50*a* of the first end portion 50 and the diameter 52*a* of the second end portion 52 are each greater than the diameter 54*a* of the intermediate portion 54. The diameter 54*a* of the intermediate portion 54 is dimensioned so that the resilient body member 22 frictionally engages the steering wheel 12 along the intermediate portion 54 of the bore 46 with the first end portion 50 and the second end portion 52 being spaced apart from the steering wheel 12. This configuration of the bore facilitates slidingly moving the resilient body member 22 along the steering wheel 12 when the resilient body member 22 is disposed about the steering wheel 12 and in the noncompressed condition. Obviously, the diameter of the bore can be varied to fit steering wheels of different sizes, as well as other objects.

Figure 5:
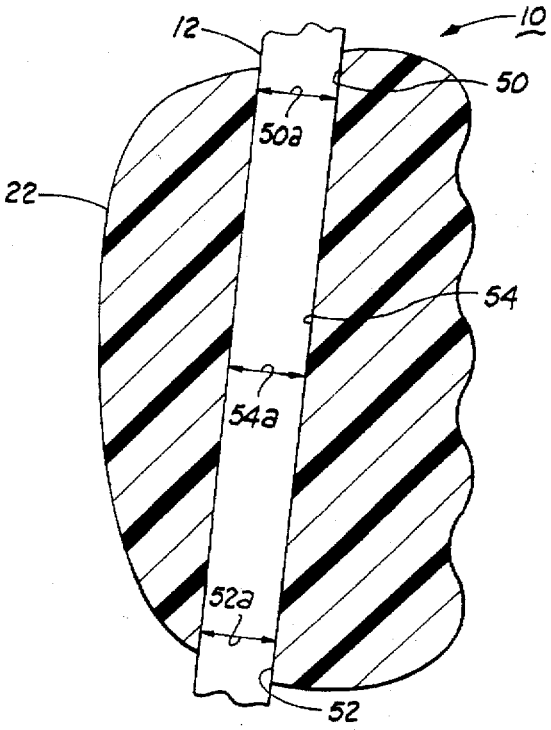
FIG. 5 is a cross-sectional view of the exercise device of FIG. 4 illustrated in a compressed condition.

FIG. 5 shows the resilient body member 22 is the compressed condition. In the compressed condition, the resilient body member 22 frictionally engages the steering wheel 12 along the first end portion 50, the second end portion 52 and the intermediate portion 54 of the bore 46 to prevent sliding movement of the resilient body member 22 along the steering wheel 12.

To secure the resilient body member 22 in the closed position to prevent the resilient body member 22 from being randomly dislodged from the steering wheel 12, the resilient body member 22 is provided with a connector assembly 56. The slit 48 of the resilient body member 22 is defined by a first wall portion 58 of the resilient body member 22 and an opposing second wall portion 60 of the resilient body member 22. Any suitable connector assembly can be used to connect the first wall portion 58 to the second wall portion 60, but preferably, the connector assembly 56 includes a hook portion 62 and a complementary loop portion 64. The hook portion 62 is attached to either of the first or second wall portions 58 or 60, and the loop portion 64 is attached to the opposing wall portion 58 or 60. The loop portion 64 cooperates with the hook portion 62 to connect the first wall portion 58 to the second wall portion 60 when the resilient body member 22 is in the closed position while permitting the first wall portion 58 to be selectively separated from the second wall portion 60 to allow the resilient body member 22 to be moved to the open position.

In use, the exercise device 10 is first positioned on an object such as the steering wheel 12. To position the exercise device 10 on the steering wheel 12, the resilient body member 22 is moved to the open position by disconnecting the hook portion 62 from the loop portion 64 and separating the resilient body member 22 along the slit 48. With the slit 48 open thereby providing access to the bore 46, the resilient body member 22 is disposed on the steering wheel 12 so that the steering wheel 12 is disposed in the bore 46. The resilient body member 22 is then adjoined and secured along the slit 48 by connecting the loop portion 64 to the hook portion 62 thereby maintaining the resilient body member 22 positioned about the steering wheel 12.

Because of the unique configuration of the bore 46 of the resilient body member 22, the exercise device 10 can be slidingly moved along the steering wheel 12 with the resilient body member 22 in the noncompressed condition to a desired position on the steering wheel 12. That is, by maintaining the resilient body member 22 in the noncompressed condition, the first end portion 50 and the second end portion 52 of the bore 46 remain spaced apart from the steering wheel 12 and enable the resilient body member 22 to be easily moved along the steering wheel 12. When the exercise device 10 is positioned where desired, the individual exercises the hand and forearm by alternately compressing and releasing the resilient body member 22 a selected number of repetitions or until fatigued.

As shown in FIG. 6, it may be desirable to utilize a pair of exercise devices 10. In this instance, the second exercise device 10 is positioned on the steering wheel 12 in the exact manner as described above. After both exercise devices 10 have been positioned and secured on the steering wheel 12, the individual may exercise both hands and forearms simultaneously while operating the vehicle.

It will be appreciated by those skilled in the art that the exercise device 10 of the present invention can be utilized on many different objects other than a steering wheel while being able to manipulate the object because the exercise device 10 frictionally engages the object when compressively gripped. Some of these objects include, a lawn mower, a bicycle, a broom handle, a vacuum cleaner, and gardening tools, such as shovel and rake.

Figure 7:
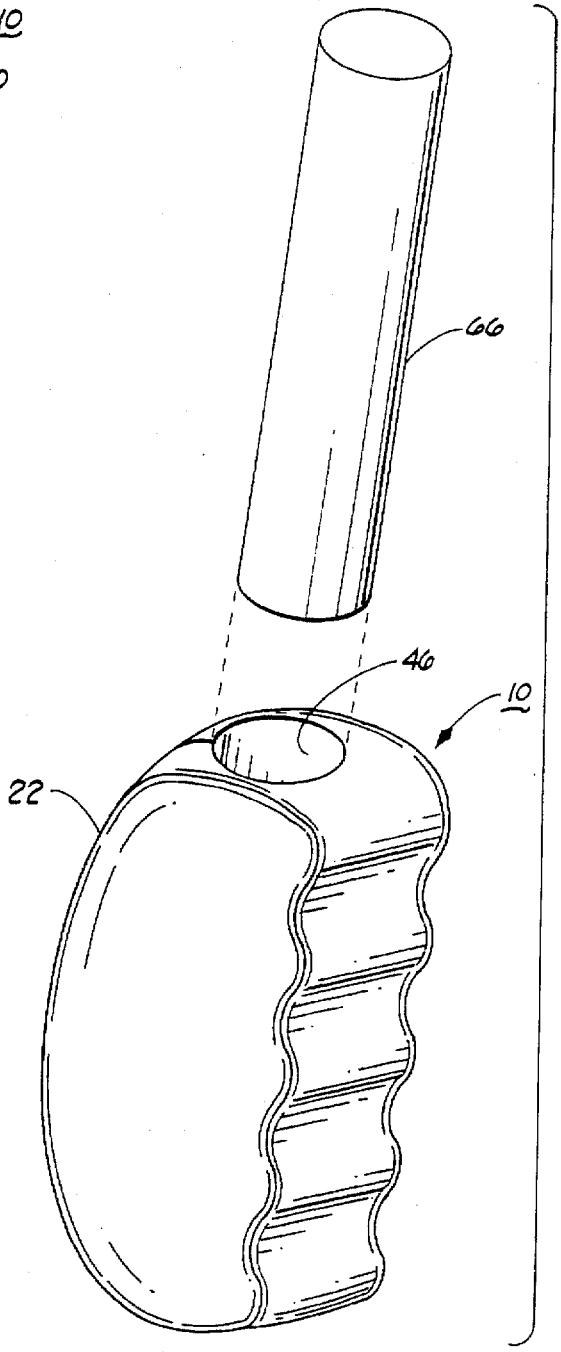
FIG. 7 is a perspective view of the exercise device of the present invention and an insert disposable in the bore of the exercise device.

An individual may occasionally wish to use the exercise device 10 while walking, jogging, or sitting at a desk. In these instances, a cylindrical insert 66 (FIG. 7) can be inserted into the bore 46 to maintain a consistent resistance. That is, the compressibility of the exercise device 10 is dependent on the compressibility of the insert 66. Therefore, if one desires the exercise device 10 to have the same resistance as when the exercise device is disposed on a substantially noncompressible object such as the steering wheel, then the insert 66 is constructed of a substantially noncompressible material, such as a plastic. On the other hand, if one desires less resistance, a more compressible material can be used to form the insert 66, such as the material discussed above for forming the resilient body member 22.

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed:

1. A device for exercising an individual's hand and forearm while grasping an object, the device comprising:

a resilient body member dimensioned to be compressively gripped with the hand of the individual, the resilient body member having an outer peripheral surface, a bore extending through the resilient body member and a slit extending from the outer peripheral surface of the resilient body member to the bore along the length of the bore such that the resilient body member is selectively movable between an open position wherein the resilient body member is separated along the slit to provide access to the bore so that the object can be positioned in the bore and a closed position wherein the resilient body member is adjoined along the slit so as to maintain the resilient body member positioned about the object, the bore having a first end portion, a second end portion and an intermediate portion, the first end portion and the second end portion each tapered relative to the intermediate portion such that the diameter of the first end portion and the diameter of the second end portion are each greater than the diameter of the intermediate portion when the resilient body member is in a noncompressed condition, the diameter of the intermediate portion sized such that the resilient body member is frictionally engages the object along the intermediate portion of the bore when the object is positioned in the bore and the resilient body member is in the noncompressed condition and the diameter of the first and second end portions sized so that each of the first and second end portions is spaced apart from the object when the resilient body member is disposed about the object and the resilient body member is in the noncompressed condition to facilitate sliding the resilient body member along the object and so that each of the first end portion, the second end portion, and the intermediate portion of the bore frictionally engages the object when the object is disposed in the bore and the resilient body member is in a compressed condition to prevent slidingly movement of the resilient body member along the object; and securing means for releasably securing the resilient body member in the closed position to prevent the resilient body member from being randomly dislodged from the object.

2. The device of claim 1 wherein the slit is defined by a first wall portion of the resilient body member and an opposing second wall portion of the resilient body member, and wherein the securing means comprises:

a hook portion attached to one of the first and second wall portions; and a loop portion attached to the opposing one of the first and second wall portions, the loop portion cooperating with the hook portion to connect the first wall portion to the second wall portion when the resilient body member is in the closed position and to permit the first wall portion to be selectively separated from the second wall portion so as to move the resilient body member to the open position.

3. The device of claim 1 wherein the object is substantially noncompressible and wherein the resilient body member has a compressibility in a range from about 400 psi to about 750 psi when the resilient body member is positioned about the object.

4. The device of claim 1 wherein the hand is further characterized as having a plurality of fingers and wherein the resilient body member is provided with a plurality of depressions formed on the outer peripheral surface along one side of the resilient body member, each of the depressions adapted to receive one of the fingers so as to position the fingers on the resilient body member and enhance the longitudinal grip of the fingers on the resilient body member.

5. The device of claim 4 wherein the hand is further characterized as having a palm and wherein the resilient body member is contoured to substantially conform to the curvature of the palm when the hand is gripped about the resilient body member.

6. A device for exercising an individual's hand and forearm while grasping a steering wheel of a vehicle, the device comprising:

a resilient body member dimensioned to be compressively gripped with the hand of the individual, the resilient body member having an outer peripheral surface, a bore extending through the resilient body member and a slit extending from the outer peripheral surface of the resilient body member to the bore along the length of the bore such that the resilient body member is selectively movable between an open position wherein the resilient body member is separated along the slit to provide access to the bore so that the resilient body member can be positioned about the steering wheel with the steering wheel disposed in the bore and a closed position wherein the resilient body member is adjoined along the slit so as to maintain the resilient body member positioned about the steering wheel, the bore having a first end portion, a second end portion and an intermediate portion, the first end portion and the second end portion each tapered relative to the intermediate portion such that the diameter of the first end portion and the diameter of the second end portion are each greater than the diameter of the intermediate portion when the resilient body member is in a non-compressed condition, the diameter of the intermediate portion sized such that the resilient body member is frictionally engages the steering wheel along the intermediate portion of the bore when the steering wheel is positioned in the bore and the resilient body member is in the noncompressed condition and the diameter of the first and second end portions sized so that each of the first and second end portions is spaced apart from the steering wheel when the resilient body member is disposed about the steering wheel and the resilient body member is in the noncompressed condition to facilitate sliding the resilient body member along the steering wheel and so that each of the first end portion, the second end portion, and the intermediate portion of the bore frictionally engages the steering wheel when the steering wheel is disposed in the bore and the resilient body member is in a compressed condition to prevent slidingly movement of the resilient body member along the steering wheel; and securing means for releasably securing the resilient body member in the closed position to prevent the resilient body member from being randomly dislodged from the steering wheel.

7. The device of claim 6 wherein the slit is defined by a first wall portion of the resilient body member and an opposing second wall portion of the resilient body member, and wherein the securing means comprises:

a hook portion attached to one of the first and second wall portions; and a loop portion attached to the opposing one of the first and second wall portions, the loop portion cooperating with the hook portion to connect the first wall portion to the second wall portion when the resilient body member is in the closed position and to permit the first wall portion to be selectively separated from the second wall portion so as to move the resilient body member to the open position.

8. The device of claim 6 wherein the steering wheel is substantially noncompressible and wherein the resilient body member has a compressibility in a range from about 400 psi to about 750 psi when the resilient body member is positioned about the steering wheel.

9. The device of claim 6 wherein the hand is further characterized as having a plurality of fingers and wherein the resilient body member is provided with a plurality of depressions formed on the outer peripheral surface along one side of the resilient body member, each of the depressions adapted to receive one of the fingers so as to position the fingers on the resilient body member and enhance the longitudinal grip of the fingers on the resilient body member.

10. The device of claim 9 wherein the hand is further characterized as having a palm and wherein the resilient body member is contoured to substantially conform to the curvature of the palm when the hand is gripped about the resilient body member.

11. A device for exercising an individual's hands and forearms while grasping a steering wheel of a vehicle, the device comprising:

a pair of resilient body members each dimensioned to be compressively gripped with one of the hands of the individual, each of the resilient body members having an outer peripheral surface, a bore extending through the resilient body member and a slit extending from the outer peripheral surface of the resilient body member to the bore along the length of the bore such that the resilient body member is selectively movable between an open position wherein the resilient body member is separated along the slit to provide access to the bore so that the resilient body member can be positioned about the steering wheel with the steering wheel disposed in the bore and a closed position wherein the resilient body member is adjoined along the slit so as to maintain the resilient body member positioned about the steering wheel, the bore of each resilient body member having a first end portion, a second end portion and an intermediate portion, the first end portion and the second end portion each tapered relative to the intermediate portion such that the diameter of the first end portion and the diameter of the second end portion are each greater than the diameter of the intermediate portion when the resilient body member is in a non-compressed condition, the diameter of the intermediate portion sized such that the resilient body member is frictionally engages the steering wheel along the intermediate portion of the bore when the steering wheel is positioned in the bore and the resilient body member is in the noncompressed condition and the diameter of the first and second end portions sized so that each of the first and second end portions is spaced apart from the steering wheel when the resilient body member is disposed about the steering wheel and the resilient body member is in the noncompressed condition to facilitate sliding the resilient body member along the steering wheel and so that each of the first end portion, the second end portion, and the intermediate portion of the bore frictionally engages the steering wheel when the steering wheel is disposed in the bore and the resilient body member is in a compressed condition to prevent slidingly movement of the resilient body member along the steering wheel; and securing means for releasably securing each of the resilient body members in the closed position to prevent the resilient body members from being randomly dislodged from the steering wheel.

12. The device of claim 11 wherein the slit of each resilient body member is defined by a first wall portion of the resilient body member and an opposing second wall portion of the resilient body member, and wherein the securing means comprises:

a hook portion attached to one of the first and second wall portions; and a loop portion attached to the opposing one of the first and second wall portions, the loop portion cooperating with the hook portion to connect the first wall portion to the second wall portion when the resilient body member is in the closed position and to permit the first wall portion to be selectively separated from the second wall portion so as to move the resilient body member to the open position.

13. The device of claim 11 wherein the steering wheel is substantially noncompressible and wherein each of the resilient body members has a compressibility in a range from about 400 psi to about 750 psi when the resilient body member is positioned about the steering wheel.

14. The device of claim 11 wherein each of the individual's hands is further characterized as having a plurality of fingers and wherein each of the resilient body members is provided with a plurality of depressions formed on the outer peripheral surface along one side of the resilient body member, each of the depressions adapted to receive one of the fingers so as to position the fingers on the resilient body member and enhance the longitudinal grip of the fingers on the resilient body member.

15. The device of claim 14 wherein each of the hands of the individual is further characterized as having a palm and wherein each of the resilient body members is contoured to substantially conform to the curvature of the palm when one of the hands is gripped about the resilient body member.

* * * * *